US005195750A

United States Patent [19]

Courialis

[11] Patent Number: 5,195,750

[45] Date of Patent: Mar. 23, 1993

[54] FOUR-PLANE GAME, GAME APPARATUS AND GAME PRODUCT

[76] Inventor: Telly Courialis, 5855 N. Sheridan Rd., Chicago, Ill. 60660

[21] Appl. No.: 867,749

[22] Filed: Apr. 10, 1992

Related U.S. Application Data

[63] Continuation-in-part of Ser. No. 720,020, Jun. 24, 1991, abandoned, which is a continuation-in-part of Ser. No. 556,950, Jul. 23, 1990, abandoned.

[51] Int. Cl.[5] ..... A63F 3/00

[52] U.S. Cl. ..... 273/241; 273/285

[58] Field of Search ..... 273/241, 268, 271, 276, 273/283, 284, 285, 287; D21/23

[56] References Cited

U.S. PATENT DOCUMENTS

| | | | |
|---|---|---|---|
| D. 226,669 | 4/1973 | Culver | D21/23 |
| D. 263,245 | 3/1982 | Bonser | D21/23 |
| D. 308,549 | 6/1990 | Gengler | D21/23 |
| 3,656,756 | 4/1972 | Gribbon, Jr. . | |
| 3,937,471 | 2/1976 | Brennan | 273/241 |
| 4,184,685 | 1/1980 | Wilson | 273/241 |
| 4,204,685 | 5/1980 | Jones | 273/241 |
| 4,333,654 | 6/1982 | Allain | 273/241 |
| 4,348,927 | 9/1982 | Escamilla-Kelly | 273/241 |
| 4,504,060 | 3/1985 | Riihiluoma et al. | 273/241 |
| 4,534,565 | 8/1985 | Hube | 273/241 |
| 4,883,278 | 11/1989 | Scott | 273/241 |
| 4,884,817 | 12/1989 | Johnson | 273/241 |

FOREIGN PATENT DOCUMENTS

| | | | |
|---|---|---|---|
| 2319914 | 9/1974 | Fed. Rep. of Germany | 273/241 |
| 2183492 | 6/1987 | United Kingdom | 273/241 |

*Primary Examiner*—V. Millin
*Assistant Examiner*—William Stoll
*Attorney, Agent, or Firm*—Walter C. Ramm

[57] ABSTRACT

A three dimensional game—with both alignment and other-than-alignment aspects—including a games-playing structure and playing-pieces. Certain spaces preferably have indicia of relative advantage. The structure comprises four playing surfaces on, respectively, a base, an upper stage substantially parallel with and spaced from the base, and each of two side stages, which also are substantially parallel and spaced from the base but intermediate a lower plane defined by the base and an upper plane defined by the upper stage. Each surface has a configuration of playing-spaces thereon, the four configurations are substantially congruent. The stages are held or carried by columns, and preferably transparent. The configurations of the base and the upper stage are preferably in vertical alignment. The structure is disclosed (a) in a first embodiment as a fixed or unified structure and (b) in a second embodiment as an assemblage of components with which it may be readily assembled and disassembled, as well as (c) in a third embodiment, also comprising readily assemblable and disassemblable components, wherein a fourth or lower stage effectively substitutes for the base. Several general forms of alternative columns are also disclosed. When disassembled the components are easily portable and may be carried in a container as a product. A player places her/his pieces on selected playing-spaces on the structure to essay winning or point-scoring formations, and/or to block an opponent's efforts to make such formations.

12 Claims, 10 Drawing Sheets

Fig. 13
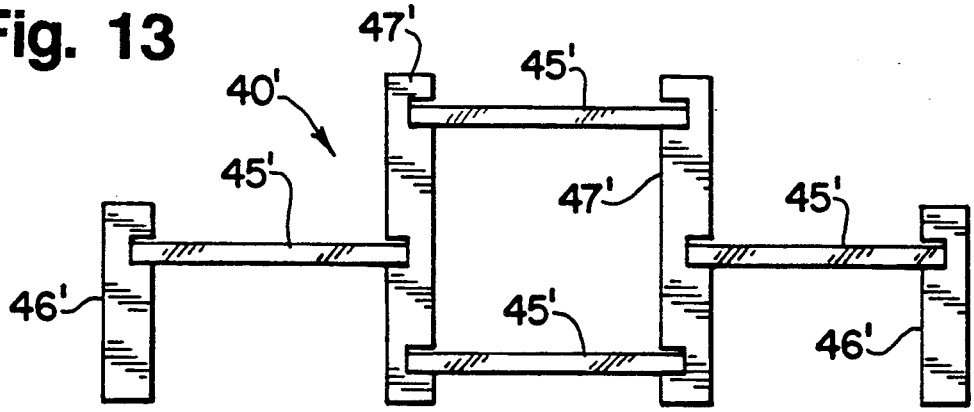
Fig. 14
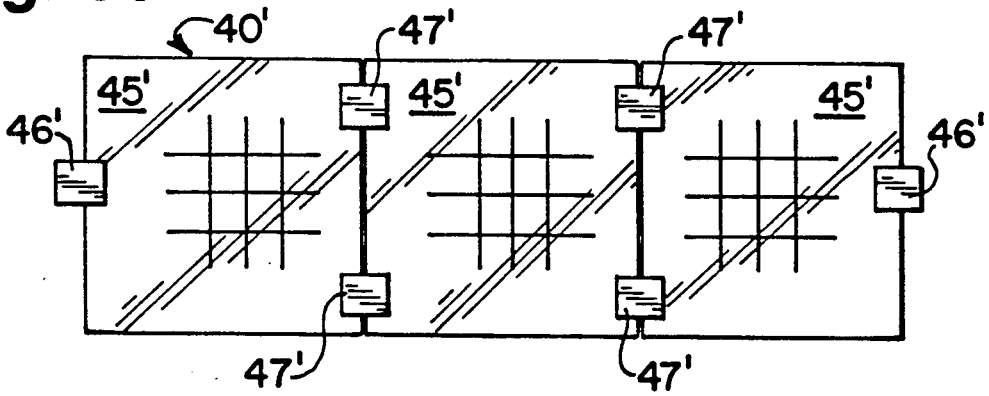
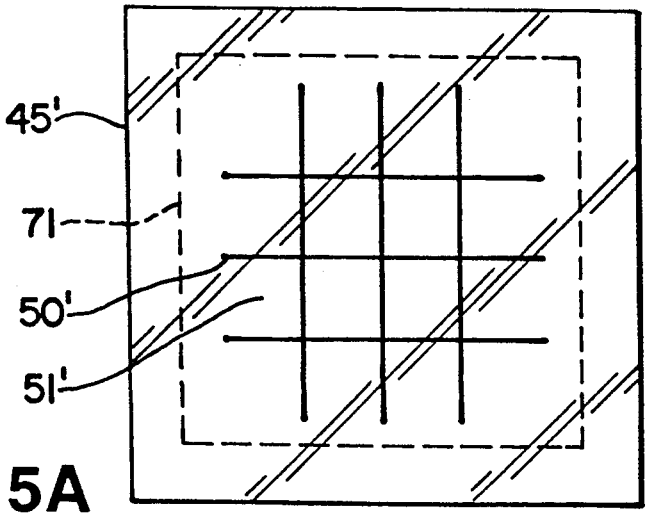
Fig. 15A

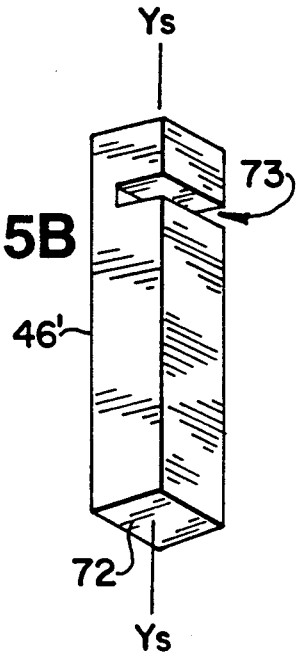
Fig. 15B
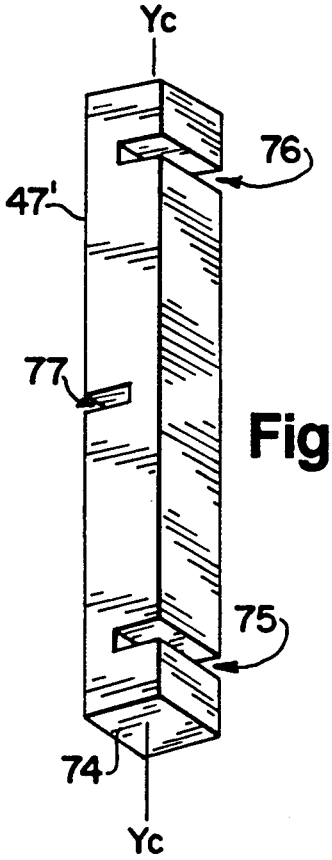
Fig. 15C
Fig. 16
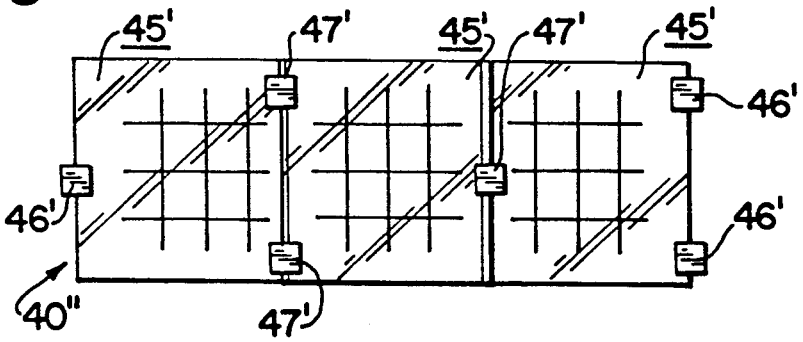
Fig. 17
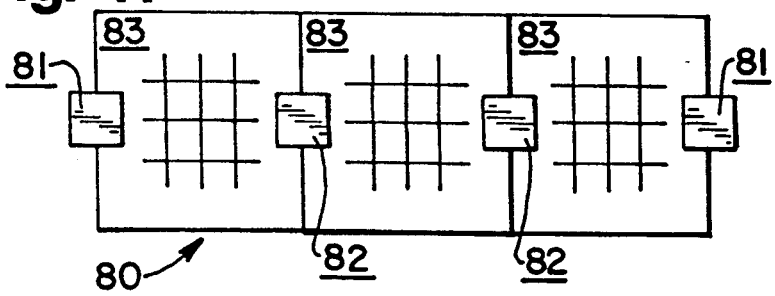

Fig. 18A
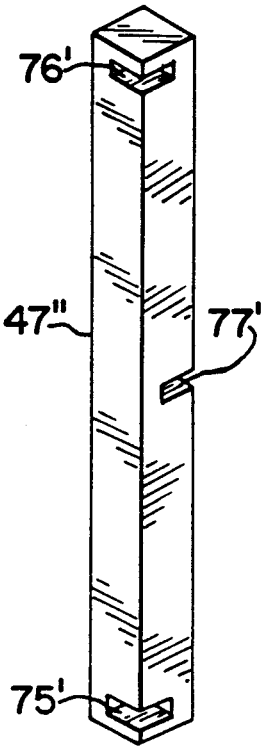
Fig. 18B
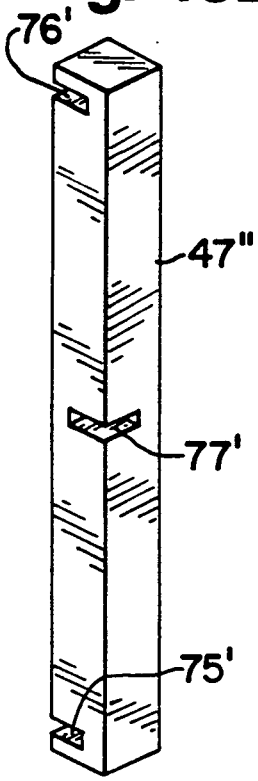
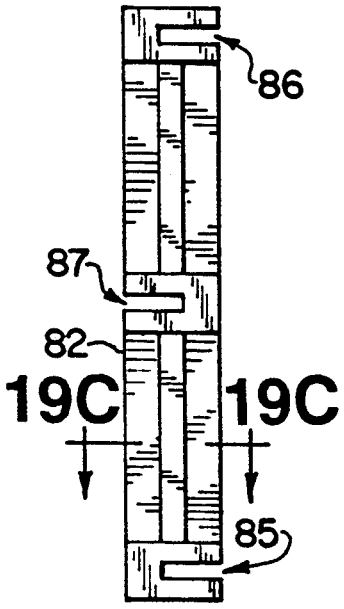
Fig. 19A
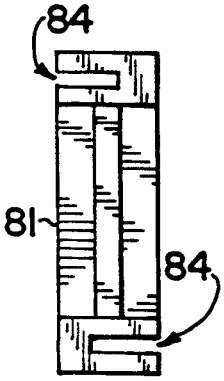
Fig 19B
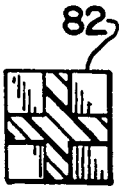
Fig. 19C

FOUR-PLANE GAME, GAME APPARATUS AND GAME PRODUCT

This application is a continuation-in-part of pending U.S. application Ser. No. 07/720,020, filed on Jun. 24, 1991, and now abandoned, which was a continuation-in-part of U.S. application Ser. No. 07/556,950, filed on Jul. 23, 1990, and now abandoned.

BACKGROUND OF THE INVENTION

1. Field of the Invention

This invention is in the field of three-dimensional board games; particularly, it includes structures with four playing-surfaces for games between opposing players. A player seeks to make a winning or point-scoring formation of his/her playing-pieces on the structure while blocking such formations essayed by an opposing player. A winning or point-scoring formation may be linear or non-linear.

2. Description of Related Art

The related art includes U.S. Pat. Nos. 4,204,685, 3,656,756, and 2,313,473.

U.S. Pat. No. 4,204,685 discloses a vertically-aligned, five-level structure for a game including a five-level linear, a five-level circular and a five-on-one-level arrangements.

U.S. Pat. No. 3,656,756 discloses a three-tier chess-type game with the top and bottom tiers substantially vertically aligned, and the middle tier offset from the said alignment.

U.S. Pat. No. 2,323,473 is an example of an early three-dimensional tic-tac-toe device.

The related art also includes the board game known as "TEEKO". In and according to the "TEEKO" game, opposing players seek to position playing-pieces on one surface and in "four-in-a-row" and "small square" winning formations, as described in Scarne, J., Scarne's Encyclopedia of Games, Harper & Row, Publishers, Inc., New York, NY, 1973.

SUMMARY OF THE INVENTION

One object of this invention is to enable novel, diverting and challenging games involving four playing surfaces, and with alignment aspects on any one surface, and other-than-alignment aspects on all four of the surfaces.

Another object of the invention is to provide an apparatus comprising a games-playing structure and playing-pieces for a game with four playing-surfaces, including assemblable structures which may be disassembled and compactly packaged when not in use.

In summary, to accomplish these objectives, a general form of structure is provided. The structure has a base, an upper stage, and two lower and generally opposed side stages; a fourth stage may alternate for the base. Playing-surfaces on the base and each stage have a configuration of playing-spaces, and the configurations may have a grid-like arrangement. The four configurations are geometrically congruent. In this specification a games-playing structure is sometimes called a "structure", a playing-piece is sometimes called a "piece", and a playing-space is sometimes called a "space".

Preferably, the configurations on the upper stage and the base are in vertical alignment, and the side stages and their configurations are displaced from such a vertical alignment as well as from alignment with each other. Also, four corresponding spaces on, respectively, the base and each stage comprise a set of spaces. At least one set of spaces may be characterized for, and carry indicia of, advantage relative to the spaces of another set. This relative advantage may pertain to game aspects such as tie-breaking and point-scoring.

In play, two players—each the opponent of the other, and seeking to place four of his/her pieces in a winning or point-scoring formation, or to block such a formation—alternately place their respective pieces on selected spaces not already occupied by a piece.

The general structure may be of some notable size. Therefore, the invention also includes particular structures which may be made relatively compact when not in use. One particular structure is an assemblage of components adapted to be assembled and disassembled.

BRIEF DESCRIPTION OF THE DRAWINGS

In the drawings:

FIG. 13 is a front elevation of another general form structure which may be assembled from and disassembled into individual components.

FIG. 14 is a plan view of the FIG. 13 structure.

FIGS. 15A–C show components for the structure of FIGS. 13–14. FIG. 15A is a plan view of a stage. FIG. 15B is an upward perspective view of a side column, and FIG. 15C is a similar view of a central column.

FIG. 16 is a plan view of one variant structure comprising the same types of components as in FIGS. 15A–C.

FIG. 17 is a plan view sketch of another variant structure.

FIGS. 18A–B are perspective views of an alternative central column and respectively show the first and second sides, and the second and third sides of the column.

FIGS. 19A–C show alternative columns of X-form cross section. FIG. 19A is a side elevation of a central column, FIG. 19B is a side elevation of a side column, and FIG. 19C is a cross section of the central column at line 19C—19C of FIG. 19A.

DETAILED DESCRIPTION OF THE PREFERRED EMBODIMENTS

The apparatus of the preferred embodiments of this invention includes a structure characterized by a base and three stages, and whereof the base has several holes and each stage has several holes. Certain holes of the stages are alignable with certain holes of the base. In this description, generically, a said hole may be either a channel (passing through) or a cavity (forming a hollow in but not passing through) a member or component, a said base or stage is sometimes called an "horizontal member", the said base and three stages are sometimes collectively called the "horizontal members", a hole in the base is sometimes called a "base-hole", a hole in a stage is sometimes called as a "stage-hole", a first preferred embodiment is called the "first embodiment", and the second preferred embodiment is called the "second embodiment".

Apparatus of the preferred embodiments includes structures with four stages and which may dispense with a distinct base. The said stages may be un-holed, and they mutually and positionally relate in the same way as the three stages and base of the first embodiment. In this description, exemplary structures with four stages are called the "third embodiment", an unholed stage is called a "whole stage", and, generally, a whole stage is an horizontal member.

FIRST EMBODIMENT

Figure 1:
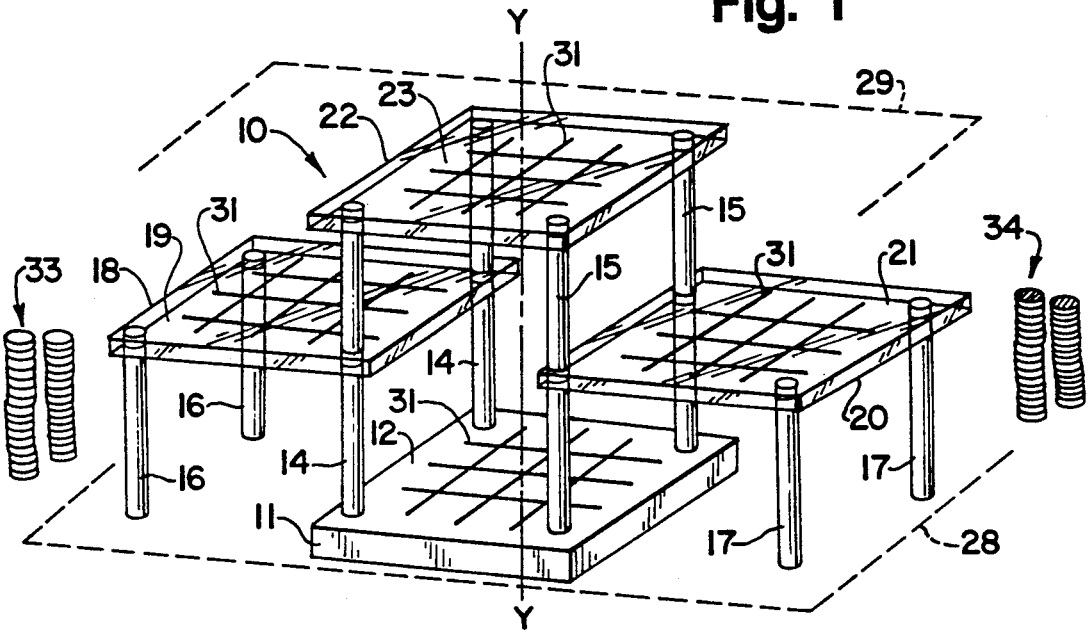
FIG. 1 is a front perspective view of the apparatus for a game of this invention, including a structure and playing-pieces.
Figure 2:
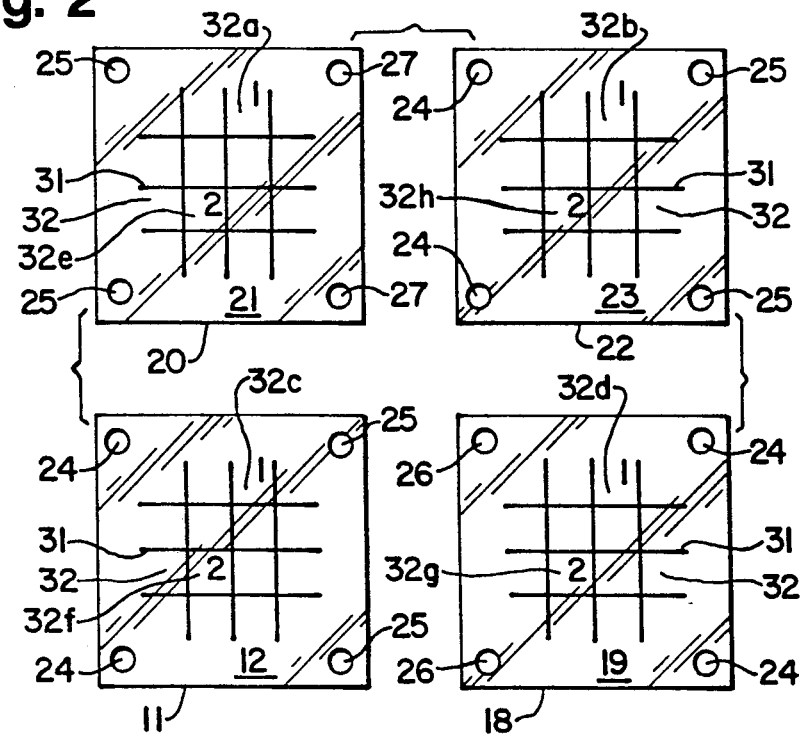
FIG. 2 is a plan view of the base and of each stage for the structure in FIG. 1, each with an exemplary configuration of spaces.

FIGS. 1-2 show the first embodiment, with reference numerals identifying these members or aspects thereof: 10 is the structure, and in structure 10, 11 is a base, 12 is a surface of base 11, 14 is a first column, 15 is a second column, 16 is a third column, 17 is a fourth column, 18 is a first side stage, 19 is a surface of stage 18, 20 is a second side stage, 21 is a surface of stage 20, 22 is a third or upper stage, and 23 is a surface of stage 22; 24 is each of several first-column holes in base 11 and stages 18 and 22; 25 is each of several second-column holes in base 11 and stages 20 and 22; 26 is a third-column hole in stage 18; 27 is a fourth-column hole in stage 20; 28 is a lower plane defined by base 11; and, 29 is an upper plane defined by stage 22.

Also, 31 is each of four configurations of playing-spaces on, respectively, surfaces 12, 19, 21 and 23); 32 is a space of a configuration 31; **32*a*, 32*b*, 32*c* and 32*d* are the corresponding spaces of an exemplary first set of spaces 32, each marked by a character "1" as an index of relative advantage; 32*e*, 32*f*, 32*g* and 32*h* are four spaces comprising an exemplary second set of spaces 32, each marked by a character "2" as an index of relative advantage; 33 represents first-player pieces; and, 34** represents second-player pieces.

FIG. 1 shows certain features of the first embodiment. Except for the demarcations defining the spaces 32 of a configuration 31 and indicia of advantage for a set of spaces, the horizontal members are transparent, and may be made, for example, of acrylic material. Surfaces 12, 19, 21 and 23 are effectively planar and parallel to plane 28. The configurations 31 on base 11 and stage 22 are in vertical alignment, and line Y—Y of FIG. 1 illustrates the alignment. Columns 14 and 15 have the same size and shape, and columns 16 and 17 have the same size and shape. The columns are cylindric and have the same (relatively small) diameter; they may be, for example, dowel-like members of transparent acrylic material or of wood.

FIG. 2 shows other first embodiment particulars. The four configurations 31 are congruent. The spaces of a set—such as spaces **32*a*, 32*b*, 32*c* and 32*d* —have corresponding co-ordinate positions. The holes 24 and 25 in one horizontal member are respectively registrable with the corresponding holes 24 and 25 in the other horizontal members. Each hole 24, 25, 26 or 27 is respectively adapted to receive a column 14, 15, 16 or 17. Each base-hole and extends and is operative between stage 20 and plane 28**, and is support means for the stage.

Finally, stage 22 is fitted and joined, via holes 24 and 25 therein, onto the upper ends of columns 14 and 15—thus to form, with those columns and base 11, a central portion of structure 10—and carried by those columns at a joinder level where surface 23 is effectively parallel with surfaces 12, 19 and 21. Accordingly, stages 18 and 20 are intermediate base 11 and stage 22, and planes 28 and 29. The height of stage 22 and spacing of columns 14 and 15 should allow a player to pass her/his hand between the columns and beneath the stage.

These joinders or joints between columns, on one hand, and base and stages, on the other, are conventionally made to form a sturdy, unified and fixed structure 10. For example, such joints may be friction-fits—in which case, to make for a snug and retentive fit, the diameter of a hole is slightly less than diameter of a received and fitted column—or, by other or additional means such as an adhesive or ancillary structural features.

In a typical structure 10 the base and each stage are about 5½inches long, 5½inches wide and ⅜ inch thick; the first and second columns have a length of somewhat more than 5 inches (thus to define the structure's height); and, the columns have a diameter of about ¼ inch.

SECOND EMBODIMENT

FIGS. 3-6 show the second embodiment of a structure of this invention, with numerals identifying these components or aspects thereof: 40 is an assembled, but disassemblable, structure, 41 is the elongate base, 42 is a first or shorter rod, 43 is a second or longer rod, 44 is a spacer element or means, 45 is each of three interchangeable stages (which may be further characterized as first, stage-hole is conventionally made, and is sized to enable a firm and retentive joinder or joint between an horizontal member and a column received in the hole. The holes may be circular with diameters matched to, and slightly smaller than, the columns' diameters.

Structure 10 is completed in several steps. First, the configuration 31 and indicia of advantage are marked on each horizontal member; the demarcations may be conventionally applied as, for example, by painting. Next, base 11 and cloumns 14 and 15 are joined in a central sub-assembly wherein each cloumn 14 is in a base-hole 24, each column 15 is in a base-hole 25, and those columns are erect and vertical with reference to plane 28, and extend upwardly.

Stage 18 and each column 16 are joined as a first side portion wherein each column 16 is in a hole 26 or stage 18 and extends at a right angle to surface 19. The central sub-assembly and first side portion are joined by fitting stage 18, with each column 16 downward and via each hole 24 therein, onto each column 14 and down to a joinder level where the vertical distance between surface 19 and plane 28 defined by the length of a column 16. Stage 18 is carried by columns 14 and 16, and surface 19 is parallel with base 28; each column 16 extends and is operative between stage 18 and plane 28, and is support means for the stage.

Stage 20 and each column 17 are joined as a second side portion, wherein each column 17 is in a hole 27 of stage 20 and extends at a right angle to surface 21. The central sub-assembly and second side portion are joined—in a manner similar to that described for, but with the second side portion in generally opposed relationship to, the first side portion thereto—so that stage 20 is carried by columns 15 and 17, and surface 21 is parallel with base 28; and, each column 17 second and third stages), 46 is a first column, 47 is a second column, 48 is a the first end of base 41, 49 is the opposed second end of base 41, 50 is one of four congruent configurations of spaces on the base 41 and the stages 45 (which may be further characterized as first, second, third and fourth configurations), 51 is a space of a configuration 50, 52 is a first hole, 53 is a second hole, 54 is a lower course of spacers 44, and 55 is an upper course of spacers 44. Numerals 51*a*, 51*b*, 51*c* and 51*d* identify the spaces of a set, each marked by a character "A" as an exemplary indicia of advantage.

Conceptually, the second embodiment differs from structure 10 of the first embodiment in that the latter is a unified structure, while the former is disassemblable, and may be made relatively compact.

Figure 4:
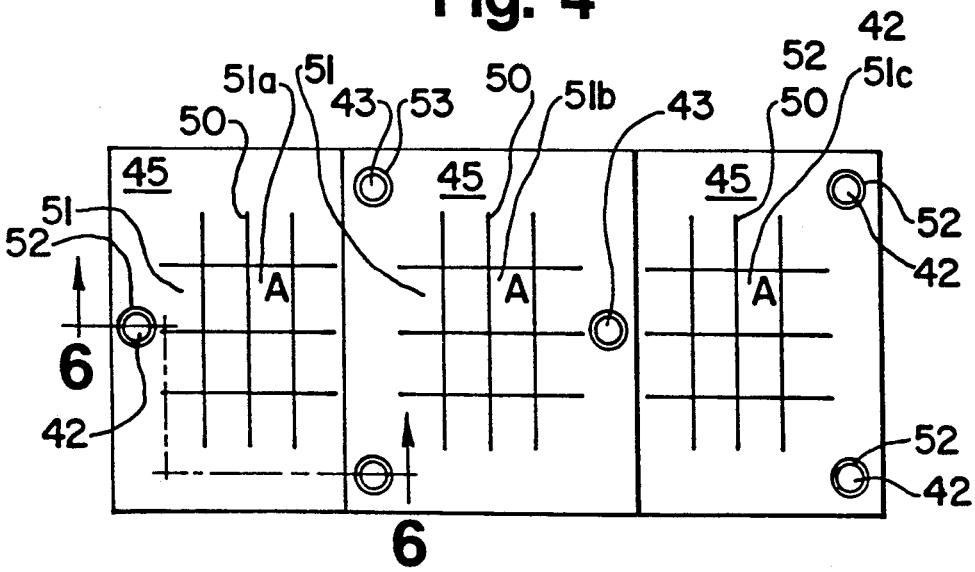
FIG. 4 is a plan view of the FIG. 3 structure.
Figure 5:
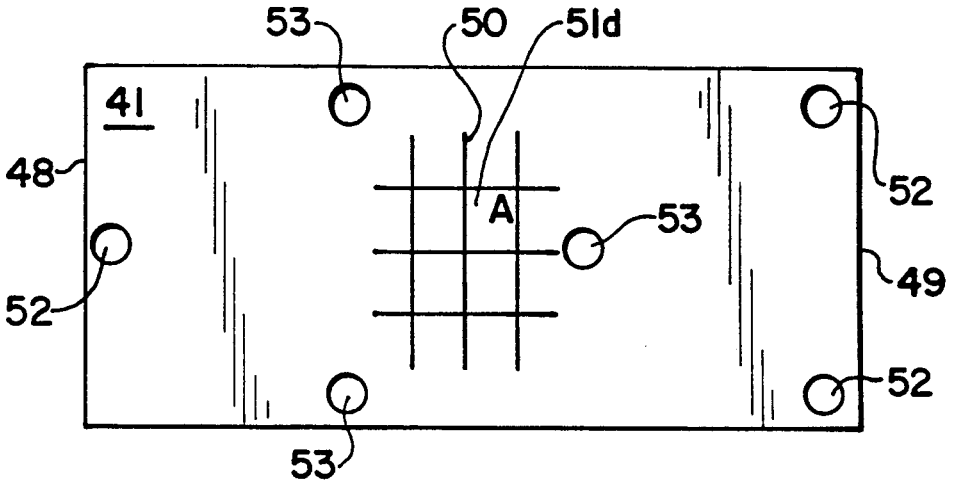
FIG. 5 is a plan view of the base of the structure of FIG. 3.

Concerning components for the second embodiment, base 41 is longer and thicker than base 11; these characteristic contribute to the assemblability and stability of structure 40. Being elongate, the base defines opposed first and second ends. Otherwise, structure 40 may be about the same length as, or somewhat smaller or larger than, and made of the same materials as structure 10. As shown in FIG. 4, a single first base-hole 52 is near end 48, two second base-holes 53 are adjacent the said single base-hole 52, two other base-holes 52 are near end 49, and one other base-hole 53 is adjacent the said base-holes 52 near end 49. Base-holes are of a uniform depth.

Spacers 44 are cylindric and of uniform size, and each defines opposed end surfaces and an axial circular channel. The axial channels, as well as holes 52 and 53 (as base-holes and stage-holes), have a uniform diameter. Rods 42 and 43 have a uniform diameter very slightly smaller than the diameter of the holes and axial channels. Base 41 is adapted to receive the rods in the base-holes, and each rod, as thus received, is held erectly by, and in removable— particularly, a close and slidable—relationship with the base, but the base and rods are not frictionally or otherwise joined.

Figure 3:
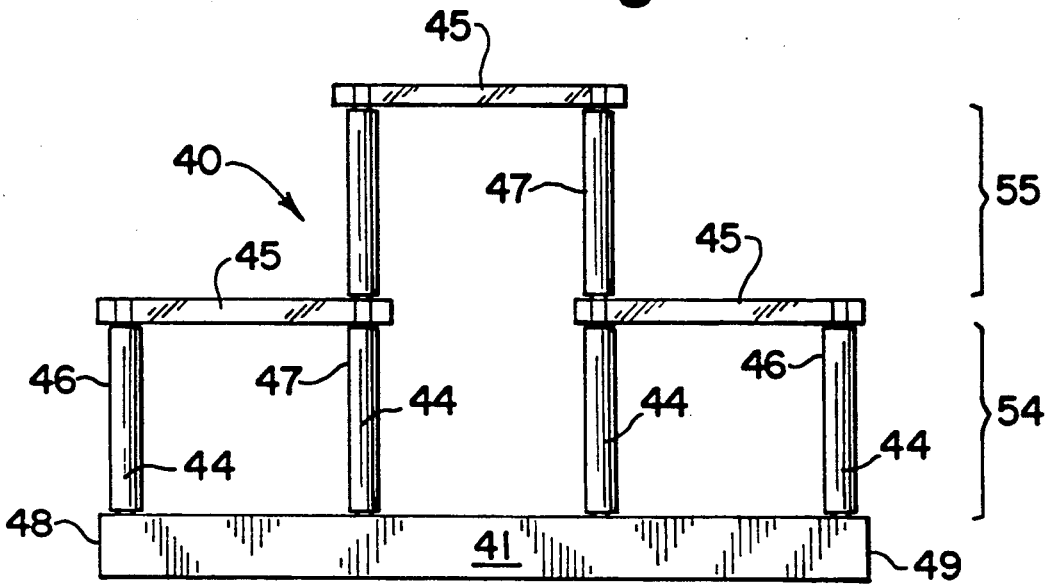
FIG. 3 is a front elevation of an alternative general form of structure which may be assembled from an assemblage of individual components, and disassembled when not in use.
Figure 6:
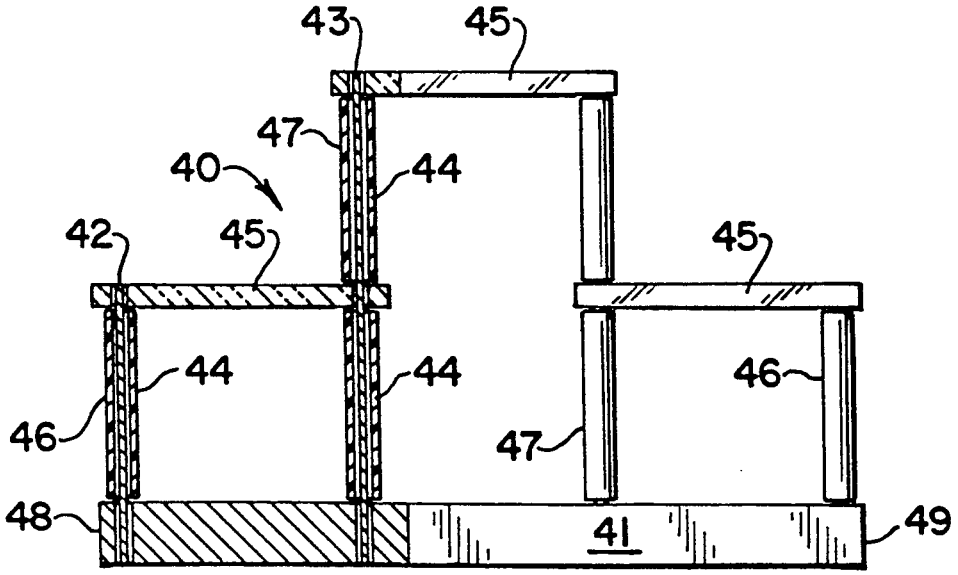
FIG. 6 is a front elevation of the FIG. 3 structure in partial section along line 6—6 of FIG. 4.

FIGS. 3 and 6 show that all spacers 44 may have substantially the same size and shape. Accordingly, and spacer is interchangeable with each other spacer, and the spacers accommodate the dimensional parameters of structure 40, and assure that the horizontal members are effectively parallel in an assembled structure. For purposes of this description a spacer 44 in or intended for lower course 54 is a "lower" spacer, and a spacer 44 in or intended for upper course 55 is an "upper" spacer. Likewise, any stage 45 is interchangeable with each other stage. As FIG. 6 suggests, the length of a rod 43 must be not less than a dimension equal to the depth of a base-hole, the length of one (lower) spacer 44, and the thickness of one stage 45; and, length of a rod 42, not less than a dimension equal to the sum of the length of a rod 43, the length of one (upper course) spacer 44, and the thickness of one (upper) stage 45.

These rods are spacers are adapted to provide columns. More specifically, one rod 42 and one spacer 44 slidably fitted thereto, via the its axial channel, comprise one first column 46; likewise, one rod 43 and two fitted spacers comprise one second column 47. Adjacent base-holes define adjacent received rods and, according to said rods, adjacent columns comprising said rods.

Figure 7:
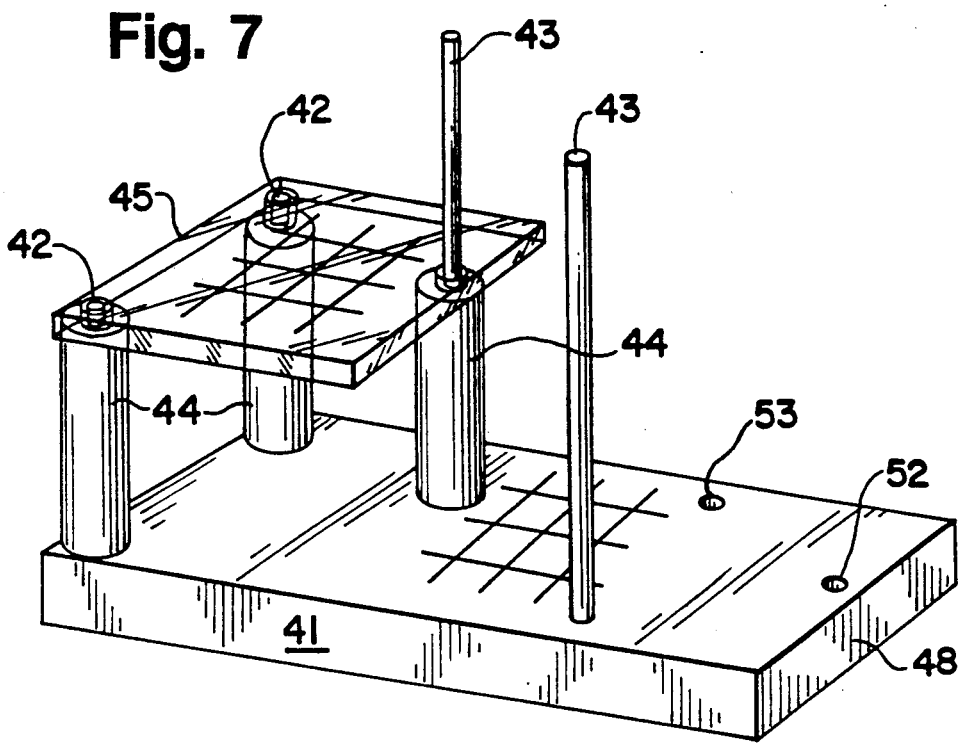
FIG. 7 is a front perspective sketch of certain components in a partial construct of the FIG. 3 structure.

The partial construct of FIG. 7 indicates the straightforward assembly and disassembly operations for putting structure 40 together or taking it apart. For assembly, and with base 41 on a flat surface, the rods are inserted—one rod 42 in each hole 52 and one rod 43 in each hole 53. The base holds inserted rods as erect, essentially vertical components. One spacer 44 is fitted downwardly on each rod to rest as a lower spacer on base 41. One stage 45 is placed, as a first side stage, over and onto each of the three adjacent rods toward end 48, and downwardly to rest upon the lower spacers of the said rods, with those rods passing through its stage-holes, and thus engaging it. Another stage 45 is placed, as a second side stage, over and onto each of the three adjacent rods toward end 49, and downwardly to rest upon the lower spacers of the said rods, with those rods passing through its stage-holes, and thus engaging it. Then, another spacer 44 is added, and fitted downwardly over and onto each rod 43, and to rest as an upper spacer on one of the said stages. Finally, third stage 45 is placed, as the upper stage, over and onto each rod 42 and to rest upon columns 47, with the rods thereof passing into or through its stage-holes and thus engaging it.

Again, for these placements and engagements of components, the diameter of rods 42 is very slightly less than the diameter of the axial channels of spacers 44 and the said stage-holes so the members are effectively urged by gravity to the form of structure 40, but they are not frictionally joined.

For disassembly, the reverse order is indicated. In sequence, the upper stage, the upper spacers, the side stages, and the lower spacers are lifted off; rods 42 and 43 are withdrawn; and the structure 40 is broken down to an aggregation of components.

THIRD EMBODIMENT

FIGS. 13–15C illustrate an exemplary structure of the third embodiment, with these numerals identifying the structure and its components or aspects: 40' is an assembled and disassemblable structure, 45' is a whole stage, 46' is a side or outer column, 47' is a central or inner column, 50' is a configuration of playing-spaces on a stage 45', 51' is a space of a configuration 50', 71 indicates a dashed line defining the peripheral margin of a stage 45', 72 is a base-end surface of and 73 is a slot in column 46', and 74 is a base-end surface of and 75, 76 and 77 are respective first, second and third slots in column 47'. In FIG. 15B, line Ys—Ys indicates the axis of column 46'. In FIG. 15C, line Yc—Yc indicates the axis of column 47'.

FIG. 16 depicts a variant structure; numeral 40'' is said variant structure; otherwise, FIG. 16 has the numerals of FIGS. 15A-C.

FIG. 17 sketches another variant structure according to the third embodiment; therein, numeral 80 identifies the structure, 81 is a side column, 82 is a central column and 83 is a stage. Structure 80 may have only four columns, that is, two of each type, in an in-line arrangement. Otherwise, columns 81 and 82, and stages 83, function like the components of other structures of the third embodiment.

A structure of the third embodiment may dispense with a distinct base, need not have any holed component or multi-element column, and requires only connectable components of three types: stages 45', columns 46' and columns 47'.

FIG. 15A shows a stage 45' with configuration 50' and margin outward of line 71. Four stages 45' are required; like stages 45, they are rigid, planar, rectangular, transparent and preferably interchangeable members of uniform size and shape, and each provides a playing-surface. Their edges may be, simply, at right angles to their playing-surfaces or, in some instances, the edges may advantageously be "bull-nosed" or otherwise slightly formed. Their configurations 50' are congruent. Certain spaces 51' may comprise sets of spaces and have indicia of advantage, exactly as spaces 32 in the first embodiment and spaces 51 in the second embodiment (see FIGS. 2 and 4).

FIGS. 15B-C illustrate a column 46' and a column 47' as elongate slotted parallelepipeds, of rectangular cross section, and adapted to stand in erect disposition on their base ends. The surface 72 or 74 is at a column's base end, and is, typically, planar and perpendicular to the column's axis. These columns, as depicted with substantially uniform cross section, are of a material—such as wood—which retains is shape during manufacture as well as is use.

In erect disposition, column 46' has slot 73 as an elevated slot and column 47' presents bottom slot 75, top slot 76, and middle slot 77 intermediate slots 75 and 76. Each slot is transverse of its column and defined by opposed columnar surfaces that are perpendicular to and may be transverse of the column's axis, with the vertical distance between said surfaces being the slot's axial dimension. Each slot has a depth corresponding to the width of the margin of a stage 45' and an axial dimension equal to, or slightly more or less than, the stage's marginal thickness, thus enabling a slot-sized portion of the margin to be inserted, received and suitably retained therein. A slot may be located by the distance between the end surface on which a column is to stand and the lower of the columnar surfaces that define the slot. Slots 75 and 76 have the same orientation to axis Yc—Yc, but slol 77 has a different orientation described as angular displacement relative to slot 76. In FIG. 15C, slot 77 has angular displacement of 180° but, depending on geometries, other angles may be indicated.

Accordingly, columns 46' and 47' may peripherally receive a stage 45' in each said slot, each stage may be so received, and a plurality of columns may carry one or several received stages. A column and a received stage must be reliably fitted—for example, frictionally—with the lower of the columnar surfaces affording an adequate area of support, but the fit need not be unduly snug.

A structure of the third embodiment may have six columns, that is, four central and two side columns as structure 40' (FIGS. 13-14) or three columns of each type as structure 40'' (FIG. 16). In and for a particular said structure, the columns 47' are interchangeable; slots 77 are at a uniform angular displacement; slots 75, 77 and 76 are respectively at uniform first, uniform second, and uniform third distances from their base ends, with said second distance greater than said first distance and said third distance greater than said second distance. Also, the columns 46' are interchangeable, with slots 73 at said uniform second distance from their base ends.

In structure 40', the four columns 47' received and cooperate to carry a first stage 45' in slots 75 and a second stage 45' in slots 76 thereof while two of the columns 47' (also cooperating in carriage of the first and second stages) and a first column 46' (at the 9 o'clock position of FIG. 14) receive and cooperate to carry a third stage 45' in each respective slot 77 and slot 73 thereof, and two other columns 47' (also cooperating in carriage of the first and second stages) and a second column 46' (at the 3 o'clock position of FIG. 14) receive and cooperate to carry a fourth stage 45' in each slot 77 and slot 73 thereof. The columns 47' serve to connect the stages 45', and, as carried and connected, the stages are substantially parallel, the first and second stages are respectively lower and upper stages, the second (upper) stage is at a first height relative to the first (lower) stage, and the third and fourth stages are in a plane intermediate the first and second stages and, relative to the first stage, at a height less than the first height.

The stages 45' are thus adapted and arranged mutually to relate like base 11 and stages 18, 20 and 22 of structure 10 (FIG. 1), with said first stage 45' in lieu of or replacing said base. And—like structure 10—structure 40' is characterized by a central portion (comprising columns 47' and said first and second stages), a first side portion (comprising said first column 46' and third stage), and a second side portion opposed to the first side portion (comprising said second column 46' and fourth stage.

In structure 40''—like the arrangement of FIG. 4—three columns 47' connect the stages and carry the first and second stages while two of the columns 47' and one column 46' carry the third stage, and the other column 47' and two other columns 46' carry the fourth stage.

Figure 20:
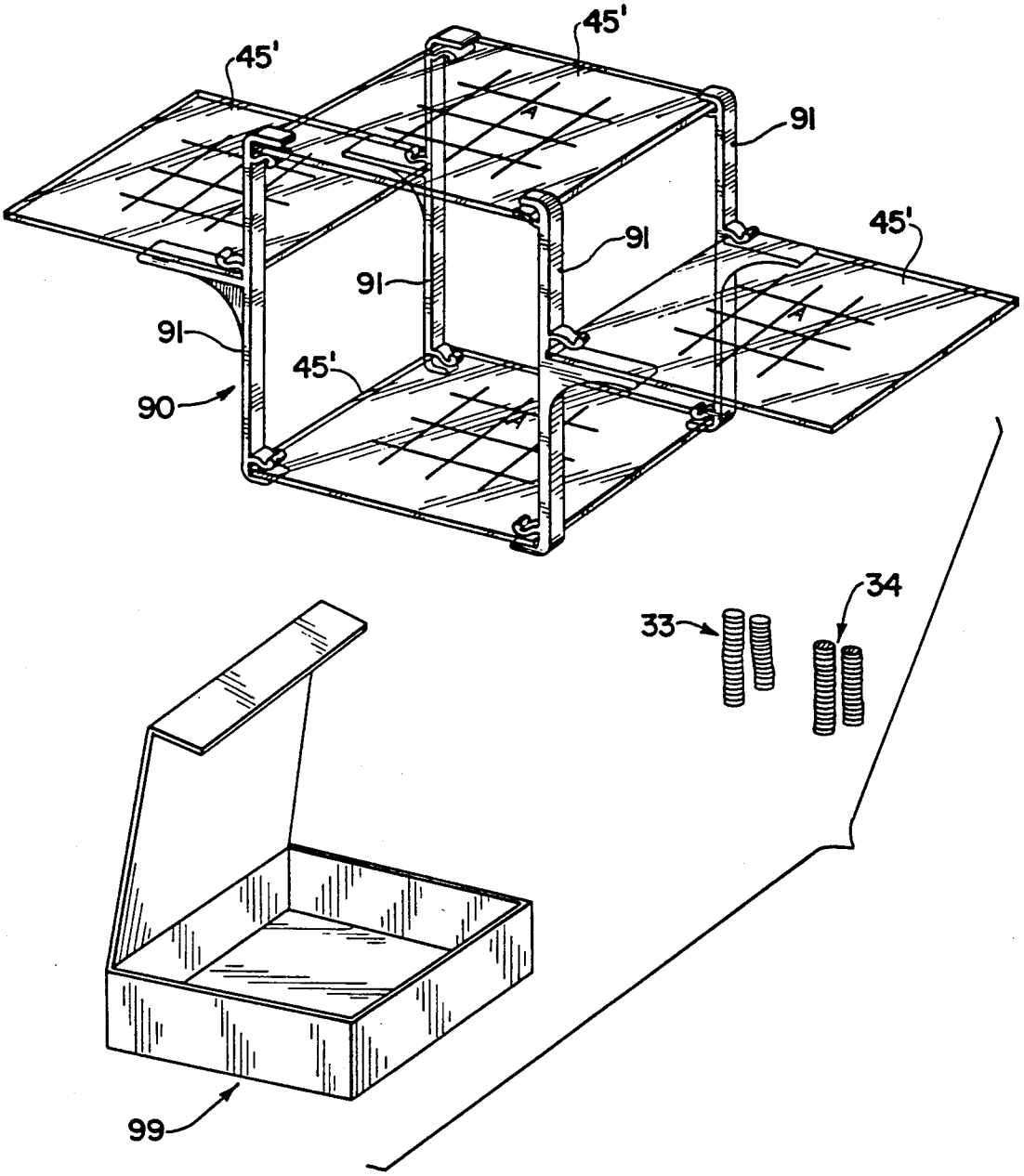
FIG. 20 is a front perspective view of still another general form of structure which may be assembled from and disassembled into individual components, and including playing-pieces and a box for the components and playing-pieces.
Figure 21:
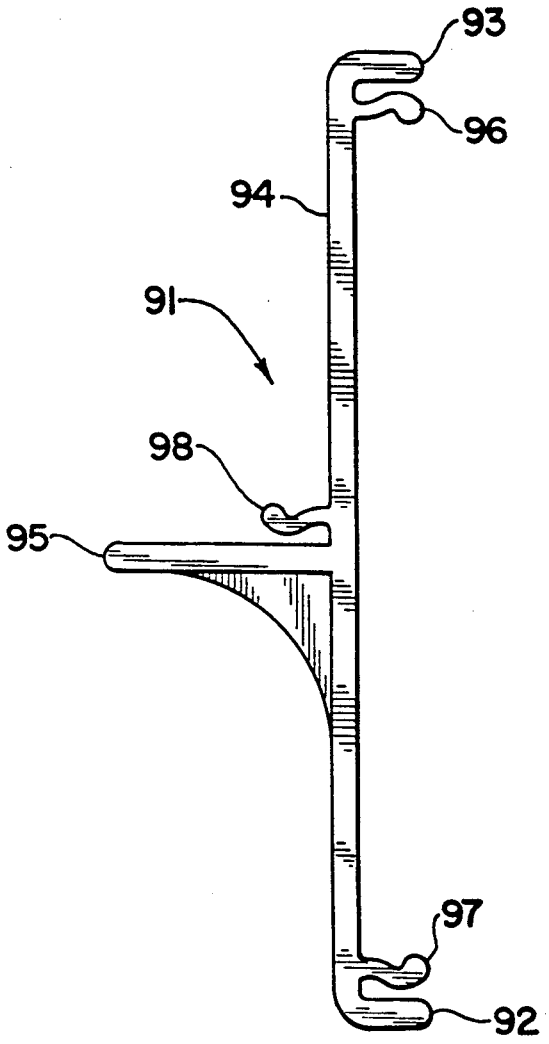
FIG. 21 is a front elevation view of column for the structure of FIG. 20.

FIGS. 21-21 relate to another exemplary general form of third embodiment structure, and these numerals identify that structure and components thereof: 90 is an assembled and disassemblable structure, 91 is a column; of and on column 91, 92 is a foot portion, 93 is an head portion, 94 is a web portion, 95 is a cantilever support arm, and 96, 97 and 98 are respective first, second and third clip-arms or clips. Also, in FIG. 20, 33 and 34 are pieces, 45' is a whole stage (with configuration 50', spaces 51' and peripheral margin), all as herein described; and 99 is a box for columns, stages and pieces.

FIG. 21 details column 91. The column, as shown, is preferably a unitary member. Web 94 is elongate and has opposed parallel sides. Foot 92 and head 93 extend from one said side, which may be called the "inward" side, and at substantially right angles; clips 96 and 97 also extend inwardly and are associated with and operatively proximate, respectively, the foot and the head. Arm 95 extends from the outer said side, which may be called the "outward" side, at substantially a right angle; clip 98 also extends outwardly and is associated with and operatively proximate the arm. The head is at a first distance from the foot, and the arm is at a second distance from the foot. For the columns 91 of a particular structure 90, said first distance is uniform, said second distance is uniform, and said second distance is less than said first distance.

Foot 92, clip 96 and the therebetween portion of web 94 provide a first or bottom clip-portion. Likewise, head 93 and clip 97 comprise a top or second clip-portion, and arm 95 and clip 98 comprise a mid-column or third clip-portion. The first and second clip-portions (including the foot and the head) are in an inward first orientation. The third clip-portion (including the arm) is in an outward second orientation. The exemplary angular displacement between said first and second orientations is substantially 180°. Each clip-portion defines a gap between the clip thereof and—as the case may be—the clip's associated head, foot or arm. Relative to the web, the head, foot and arm are substantially rigid.

Clips 96, 97 and 98 are flexile and resilient. Each said clip is adapted in response to appropriate force to flex or bend slightly away from its associated head, foot or arm, and so to open or widen its gap, and, absent such force, to maintain and to resume unflexed status. When a clip is unflexed, its clip-portion defines a minumum gap-width. For the columns 91 of a particular structure 90, this minimum width is substantially uniform. The clips' free ends may have a curvature so that, at the open ends of the clip-portions, the gap is wider than the minimum width. The minimum width is less than the thickness of the peripheral margin of the stage 45'.

FIG. 20 shows assembled structure 90 with four central columns, as, specifically, first, second, third and fourth columns of the column 91 type. Those columns stand upon their feet 92 in erect disposition, their webs 94 define the structure's central portion, their arms 95 present upwardly-disposed support surfaces, and they receive, grip and cooperate to carry a first stage 45' in their bottom clip-portions and a second stage 45' in their top clip-portions. The first and second columns receive, grip and cooperate to carry a third stage 45' in their mid-column clip-portions and in cantilever fashion on their arms 95, and, in like manner, the third and fourth columns receive, grip and cooperate to carry a fourth stage 45'. The third and fourth stages—with and in the third clip-portions, and with and on the arms thereof—respectively form the structure's first and second side portions. The stages are generally horizontal, and the columns serve to connect them in parallel, or substantially or nearly parallel, relationship. The flexile and resilient character of clips 96, 97 and 98 is advantageous because it confers capabilty positively to grip and to exert a retaining effect on stages in clip-portions, and thereby strengthens the structure.

Structures of the third embodiment are readily adapted for easy hand assembly by connecting or disconnecting the components thereof—that is, inserting the stages in the slots and co-positioning the components as described and as depicted, or withdrawing the stages from the slots. Alternatively, the components may, by conventional means, be more permanently connected.

In particular, as to structure 90, stages 45' may readily be inserted in or withdrawn from the clip-portions of each column 91. A stage is inserted with force suitably to flex the clip and open the gap; however, as inserted, a stage must not strain, overly flex, or otherwise impair the clip or the clip's ability to grip the stage. Typically, insertion is a prying-like action wherein an edge portion of the stage applies the force and flexes the clip. The curvature of a clip's free end and bull-nosed edges on the stage aid the insertion. As in FIG. 20, marginal portions of received stages should be fitted well into the clip-portions, and respective clip-portions (and columns) are preferably at or close to the stages' transverse edges. In some instances, depending on the sizes of the columns and the stages, the structure's erectly-disposed columns may tend to bow outwardly in minimal or slight degree.

Components for structures of the third embodiment may be of any suitable materials, such as materials indicated for the first and second embodiments, and fabricated by conventional means. The components of an exemplary set for structure 40' have these characteristics and dimensions: Stage 45' is square, approximately 5½ inches on a side, and has uniform thickness of about ⅛ inch. Columns 46' and 47' have square cross sections of ⅝ inch on a side. Column 46' has height of 3-3/16 inches. Column 47' has height of 5¾ inches. All slots have axial dimension of ⅛ inch and depth of ⅜ inch. A first distance of ¼ inch locates slot 75, a second distance of 2-13/16 inches locates slot 77, and a third distance of 5⅜ inches locates slot 76, and, with slots 75 and 76, and slot 77, at equal distances from respective ends thereof, a column 47' is reversible in that either said end may be a base end. The lower columnar surface locating slot 73 is 2-13/16 inches from surface 72.

Columns 91 may be injection molded of synthetic resinous plastic material, such as the "DELRIN" product of E.I. duPont de Nemours and Company, of Wilmington, Del., and, preferably, with a "memory", to assure the flexile and resilient character of the clips. The thin, arcuate-edged portion of column 91 between web 94 and arm 95, shown in FIGS. 20 and 21, derives from the sprue of the mold wherein the column was formed and is not an essential part of the column. Otherwise, structure 90 components may have these exemplary characteristics and dimensions: Stage 45', as in the preceding paragraph. Column 91 has overall height of approximately 5¼ inches. Generally, and exclusive of said sprue portion, web 94 has rectangular cross section of ⅛ inch×5/16 inch, and arm 95 has the same cross section as the web. Foot 92 and head 93 have the same cross section as the web, and each extends inwardly about ⅜ inch. The head-to-foot dimension ("first distance") is about 5 inches, and the arm-to-foot dimension ("second distance") is approximately 2½ inches. Minimum gap-width is 3/32 inch. Also, columns with said exemplary dimensions may, as well, provide a structure comprising whole stages whereof the side dimension is smaller than 5½ inches.

Structure 90 comprises components of only two types—columns 91 and stages such as stages 45'. Relative to other game structures (including other third embodiment structures), said components and other game articles, such as pieces 33 and 34, may be packaged in square, shallow box 99, whereof a side dimension is slightly larger than the stages' side dimension, with the stages stacked at the bottom and the columns and other game articles atop the stages.

ALTERNATIVE AND ADDITIONAL COMPONENTS

Figure 8:
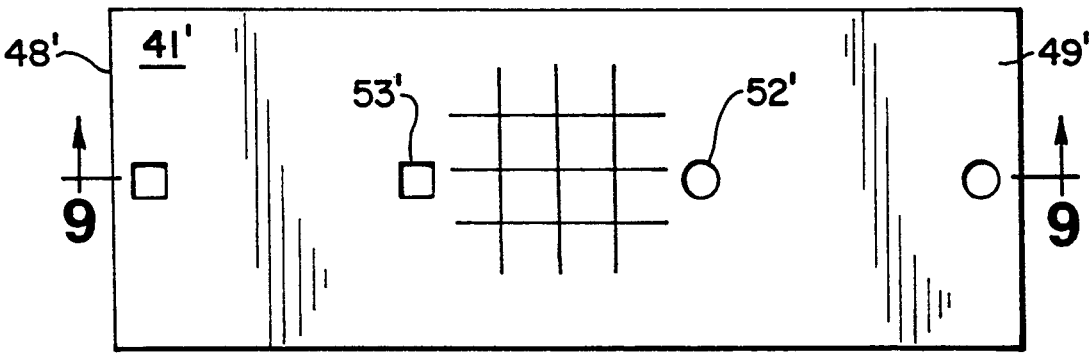
FIG. 8 is a plan view of an alternative base for an assemblable structure of this invention.
Figure 9:
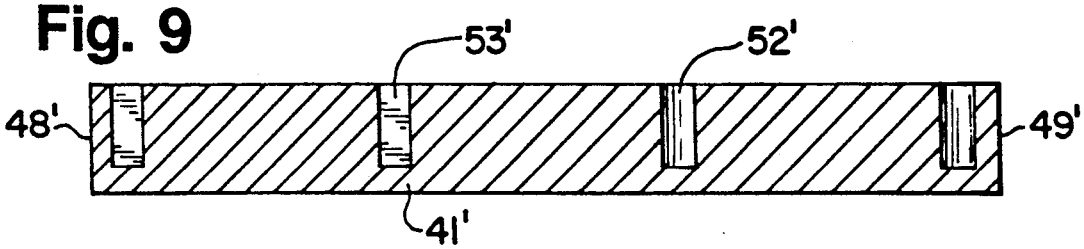
FIG. 9 is a front sectional view of the FIG. 8 alternative base along line 9—9 of FIG. 8.

The alternative elongate base of FIGS. 8–9, for a structure of the second embodiment, is described in terms of these numerals: 41' is the base, 48' in one end, 49' is the other end, 52' is a first base-hole of circular cross section, 53' is a second base-hole of rectangular cross section. FIG. 9 shows the base-holes 52' and 53' for the base may be cavities as well the channels of FIG. 4, and need not be limited to circular holes.

Figure 10A:
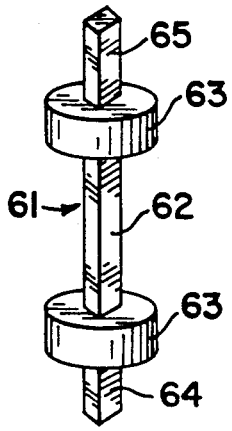
FIG. 10A is a perspective sketch of a flanged column.
Figure 10B:
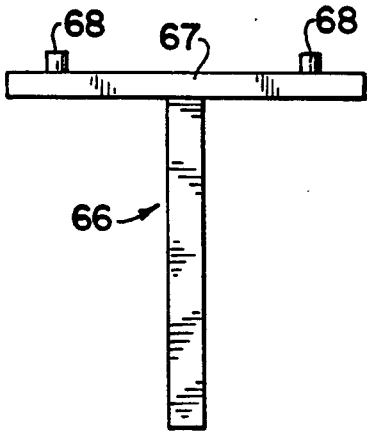
FIG. 10B is a side elevational sketch of a beam-on-column member, each an alternative component for a structure of this invention.

Elements and aspects of the alternative columns, spacer means and support means of FIGS. 10A–10B, for structures of the first and second embodiments, are identified by these numerals: in FIG. 10A, 61 is a column, 62 is a shank of column 61, 63 is each of two spaced flanges on shank 62, 64 is the lower end, and 65 is an upper end of column 61; and, in FIG. 10B, 66 is a column, 67 is a beam-like upper portion of column 66, and 68 is an upper prong on portion 67. Column 61 is rectangular in cross section, and it end 64 is adapted to be received in a base-hole 52'; its two flanges 63 are spacer means, and it is functionally equivalent to the spacing and support afforded by a spacer 44. Only two columns 66—one as a first column and the other as a second column, and with the beam-like portions 67 affording extensive front-to-back support—could well suffice to support a stage.

Figure 11:
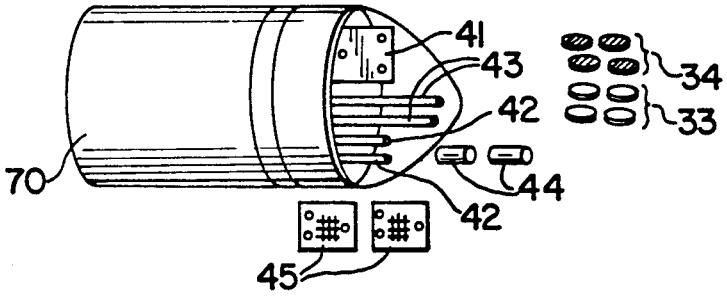
FIG. 11 is a sketch of a presentation of members of the FIG. 3 structure, in disassembled condition, and a container.

The presentation of FIG. 11, wherein numeral 70 identifies a container—such as a pouch or envelope—shows disassembled components of structure 40, with pieces 33 and 34, in or adapted to be received in container 70, as a product. The presentation may be, for example, a kit for or readily portable travel version of a games product. Likewise, a set of components of a structure 40', 40'' or 80, with said pieces, may be packaged and presented as a product in a container, such as container 70.

The alternative central column of FIGS. 18A–B and aspects thereof are identified by these numerals: 47'' is the column, and 75', 77' and 76' are respective bottom, middle and top slots thereof. Column 47'' is a corners column. These slots are provided as corner slots; each is a cavity or niche with rectangular columnar surfaces and corresponding to a corner marginal portion of a stage 45', so a said portion may be received therein. Relative to slot 75', the angular displacement of slot 77' is 90°. In a structure such as structure 40'', columns 47'' readily substitute for columns 47' to carry stages 45'; no substitution is needed for columns 46' (although, optionally, side columns could be provided as corner columns).

The alternative columns of FIGS. 19A–C and aspects thereof are identified by these numerals (including, because these columns are suitable for a structure such as structure 80, numerals of FIG. 17): 81 is a side column, 82 is a central column, 84 is each of two slots in column 81, and, in column 82, 85 is a first slot, 86 is a second slot and 87 is a third slot. Relative to slot 85, the angular displacement of slot 87 is 180°. As shown, columns 81 and 82 are reversible members and either of their end surfaces may be a base-end surface; either slot 84 may be an elevated slot; the third (middle) slot 87 and each slot 84 are at equal distances relative to the respective base ends of columns 81 and 82; and, a greater part of each column 81 or 82 is of an X-form cross section. This X-form is advantageous because it enables columns made be conventional injecting molding of plastics materials to have shape-retaining and other desired properties as to cooling, removal from the mold and in use.

PLAY OF GAMES

Figure 12A:
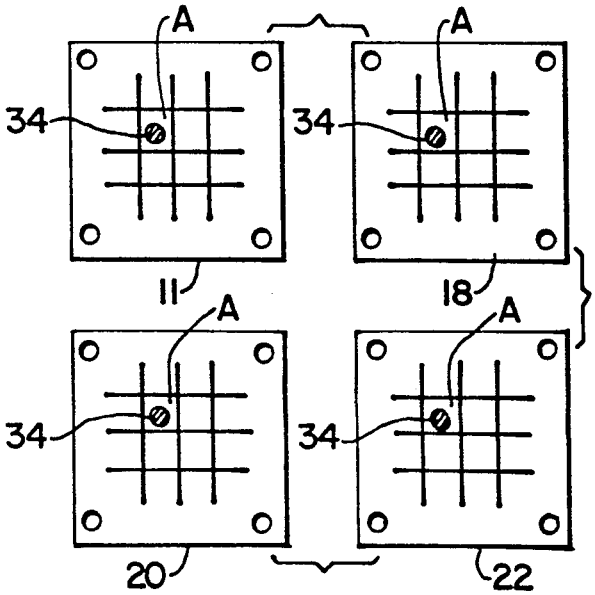
FIGS. 12A and 12B show exemplary winning formations of pieces.
Figure 12B:
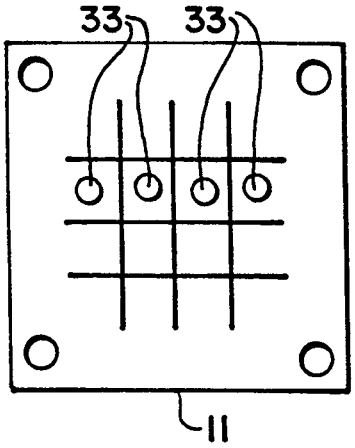

A variety of games, according to particular rules and scoring formulae, may be played with apparatus of this invention. An expemplary configuration, as may be provided for the first and the second embodiment is a square grid of sixteen spaces. Pieces 33 and 34 are small discs, or chips, or similar pawn-like elements and respectively distinguished, as by different colors; each is suitable to place upon, and not to overlap, a space 32 or 51, or a space 51'. FIG. 12A wherein four pieces of one player are aligned as a "Line-Drive" (in the lexicon of one exemplary game) formation, and FIG. 12B, wherein one player's pieces occupy a set of spaces as a "Block-Buster" (in the same lexicon) formation, illustrate exemplary winning or point-scoring formations. Where a Block-Buster is made on a set with indicia of advantage, such as the set **32*a*, 32*b*, 32*c* and 32*d* of FIG. 2, such sets enable game refinements in tie-breaking or scoring. For several such games, thirty-two pieces 33 and thirty-two pieces 34** are provided.

Apart from the first and second embodiments, the third embodiment, and alternative members and components, as disclosed, and the play of games sketched herein, other games-playing structures, apparatus and products are within the spirit and scope of this invention.

What is claimed is:

1. A games-playing structure comprising a central portion comprising a base defining a lower plane and a first surface with a configuration of spaces, and an upper stage connected with the base and defining an upper plane substantially parallel with the lower plane, and a second surface with a configuration of spaces;

a first side portion including a first side stage defining a third surface with a configuration of spaces and support means operative between the first side stage and the lower plane, and joined with the central portion intermediate the lower and upper planes;

a second side portion including a second side stage defining a fourth surface with a configuration of spaces and support means operative between the second side stage and the lower plane, and joined with the central portion intermediate the lower and upper planes, and generally opposed to the first side portion;

wherein the configurations are substantially congruent.

2. Apparatus for playing games between first and second players comprising the structure of claim 1, a plurality of first-player playing-pieces and a plurality of second-player playing-pieces, whereof each playing-piece is adapted to be placed on a said space.

3. A unified games-playing structure according to claim 1 wherein the central portion includes at least one first column joined with, held erectly by, and extending upwardly from the base, and at least one second column joined with, held erectly by, and extending upwardly from the base; the upper stage is carried at least on one first column and one second column; the first side stage is carried on at least one first column and the second side stage is carried on at least one second column; at least one third column is joined with the first side stage and extends between the first side stage and the lower plane; at least one fourth column is joined with the second side stage and extends between the second side stage and the lower plane; and, the configurations on the base and on the upper stage are in vertical alignment.

4. Apparatus for games between first and second players comprising the structure of claim 3 wherein each stage is substantially transparent; each configuration is a square grid of sixteen spaces; four spatially-corresponding spaces on, respectively, each said configuration comprise a set of spaces; the spaces of at least one set of spaces carry indicia of advantage; thirty-two first-player playing-pieces; and, thirty-two second-player playing-pieces.

5. A games-playing structure of assemblable components comprising an elongate base defining a configuration of spaces, first and second ends, at least one first base-hole near the first end, at least one other first base-hole near the second end, at least one second base-hole adjacent the first base-hole near the first end, and at least one other second base-hole adjacent the first base-hole near the second end;

at least two first columns, each slidably received in a first base-hole, erectly held by the base and having lower spacer means;

at least two second columns each slidably received in a second base-hole, erectly held by the base, and having lower spacer means and upper spacer means;

first, second and third stages, each defining a planar surface, a configuration of spaces and three stage-holes;

whereof adjacent base-holes locate adjacent columns; the configurations are congruent; the first stage is carried on the lower spacer means of a least two adjacent columns; the second stage is carrried on the lower spacer means of at least two other adjacent columns; at least one upper spacer means rests on the first stage; at least one upper spacer means rests on the second stage; and the third stage is carried on the second columns and atop the upper spacer means.

6. An assemblable games structure of components comprising a base defining a configuration of spaces, first and second ends, one first base-hole near the first end, two other first base-holes near the second end, two second base-holes adjacent the said one first base-hole, and one other second base-hole adjacent the said two other first base-holes;

first, second and third stages, each defining a planar surface, a configuration of spaces and three stage-holes;

three assemblable first columns, each including, as assembled, a first rod adapted to be removably received in a first base-hole and, as received, held erectly by the base, and a lower spacer adapted to be removably fitted with the first rod and, as fitted, rest on the base;

three assemblable second columns, each including, as assembled, a second rod adapted to be removably received in a second base/-hole and, as received, held erectly by the base, a lower spacer adapted to be removably fitted with the second rod and, as fitted, to rest on the base, and an upper spacer adapted to be removably fitted with the second rod and, as fitted, to rest on a stage;

whereof the configurations are congruent; adjacent base-holes, locate adjacent columns according to the received rods of said columns; three adjacent columns are to carry the first stage on their lower spacers and with a different one rod in each stage-hole of the first stage; three other adjacent columns are to carry the second stage on their lower spacers and with another different one rod in each stage-hole of the second stage; and, the second columns are to carry the third stage on their upper spacers and with a different second rod in each stage-hole of the third stage.

7. A product, for games to be played between first and second players, comprising an assemblable games structure of components according to claim 6 wherein each rod is adapted to be slidably received in a base-hole; each spacer is cylindric and defines opposed end surfaces and an axial channel, and is adapted to be slidably fitted, via the channel, on a rod; the first rods are interchangeable; the second rods are interchangeable; the spacers are interchangeable; and the stages and interchangeable and substantially transparent; each configuration is a grid of sixteen playing-spaces; four corresponding playing-spaces of, respectively, each configuration comprise a set of spaces; a first set of spaces has indicia of advantage relative to other playing-spaces; and, a second set of spaces has indicia of advantage relative to other playing-spaces except the first set; whereof at least some of said components are disassembled; and, thirty-two first-player pieces and thirty-two second-player pieces, each said piece defining an area less than the area of one playing-space; and, a container for said components and pieces.

8. A games structure comprising a central portion including a first stage and a second stage connected with and at a first height relative to the first stage;

a first side portion extending from the central portion and including a third stage connected with the central portion at a height, relative to the first stage, of less than said first height;

a second side portion extending from the central portion and generally opposed to the first side portion, and including a fourth stage connected with the central portion at a height, relative to the first stage, of less than said first height;

wherein the stages are generally horizontal and substantially parallel with each other, each stage is of uniform size and shape, each stage provides a playing-surface and a configuration of playing-spaces, and the configurations are substantially congruent.

9. A game product comprising the structure of claim 8, thirty-two first-player playing-pieces, and thirty-two second-player playing-pieces.

10. An assemblable games structure of components comprising a plurality of columns whereof each column has a first clip-portion including a foot in a uniform first orientation as to the column, a second clip-portion including a head at uniform first distance from the foot and in said first orientation, and a third clip-portion including a support arm at a uniform second distance from the foot and in a uniform second orientation as to the column, and wherein the first distance is greater than the second distance, and the second orientation is angularly displaced from the first orientation;

a plurality of stages whereof each stage has a peripheral margin, provides a playing-surface and a configuration of playing-spaces, and in adapted to be peripherally received in a clip-portion, and wherein the configurations are congruent;

so that in the structure, as assembled, the columns stand in erect disposition on their respective feet, and receive, grip and cooperate to carry a first stage in their first clip-portions and a second stage in their second clip-portions; a first column and a second column receive, grip and cooperate to carry a third stage in respective third clip-portions of said first and second columns, with the third stage disposed in cantilever fashion on the support arms thereof; and, a third column and a fourth column receive, grip and cooperate to carry a fourth stage in respective third clip-portions of said third and fourth columns, with the fourth stage disposed in cantilever fashion on the support arms thereof.

11. The structure of claim 10 wherein each column includes a web intermediate said column's foot and head; and wherein, as to each column, the web defines inward and outward sides; the foot and the head extend from the inward side; the support arm extends in cantilever fashion from the outward side; the first clip-portion includes a first clip proximate the foot; the second clip-portion includes a second clip proximate the head; the third clip-portion includes a third clip proximate the support arm; said clips are flexile; and, each clip-portion defines a gap which, when the flexile clip thereof is unflexed, has a minimum width of slightly less than the thickness of the peripheral margin of a stage adapted to be received in and gripped by said clip-portion.

12. A games product for games between first and second players comprising the structure of claim 10 wherein each column is a unitary member and of material characterized by memory; each configuration is a square grid of sixteen spaces; for spatially-corresponding spaces on, respectively, each said grid, each said configuration comprises a set of spaces; the spaces of at least one set carry indicia of advantage; thirty-two first-player playing-peices; thirty-two second-player playing-pieces; and, a container for components of the structure and the playing-pieces.

* * * * *